United States Patent [19]

Choy et al.

[11] Patent Number: 4,657,692

[45] **Date of Patent: * Apr. 14, 1987**

[54] THICKENED AQUEOUS ABRASIVE SCOURING CLEANSER

[75] Inventors: Clement K. Choy, Walnut Creek; Frederick I. Keen, Manteca, both of Calif.

[73] Assignee: The Clorox Company, Oakland, Calif.

[ * ] Notice: The portion of the term of this patent subsequent to Jul. 8, 2003 has been disclaimed.

[21] Appl. No.: 727,702

[22] Filed: Apr. 26, 1985

Related U.S. Application Data

[63] Continuation-in-part of Ser. No. 603,266, Apr. 20, 1984, Pat. No. 4,599,186.

[51] Int. Cl.[4] ..... C11D 1/75; C11D 1/83; C11D 3/14; C11D 3/395

[52] U.S. Cl. ..... 252/99; 252/95; 252/102; 252/155; 252/174.25; 252/DIG. 14

[58] Field of Search ..... 51/304, 308; 252/96, 252/95, 103, 140, 145, 155, DIG. 14, 99

[56] References Cited

U.S. PATENT DOCUMENTS

| | | | |
|---|---|---|---|
| 3,149,078 | 9/1964 | Zmoda | 252/99 |
| 3,530,071 | 9/1970 | Moore | 252/99 |
| 3,558,496 | 1/1971 | Zmoda | 252/95 |
| 3,560,389 | 2/1971 | Hunting | 252/95 |
| 3,579,456 | 5/1971 | Cambre | 252/137 |
| 3,630,922 | 12/1971 | McClain et al. | 252/99 |
| 3,677,954 | 7/1972 | Nakajima et al. | 252/121 |
| 3,684,722 | 3/1972 | Hynam et al. | 252/98 |
| 3,702,826 | 11/1972 | Koceich et al. | 252/99 |
| 3,715,314 | 2/1973 | Morgenstern | 252/95 |
| 3,716,488 | 2/1973 | Kolsky et al. | 252/155 |
| 3,758,409 | 9/1973 | Nakagawa et al. | 252/99 |
| 3,843,548 | 10/1974 | James | 252/187 |
| 3,929,661 | 12/1975 | Nakagawa et al. | 252/103 |
| 3,956,158 | 5/1976 | Donaldson | 252/102 |
| 3,981,826 | 9/1976 | Munro | 252/526 |
| 3,985,668 | 10/1976 | Hartman | 252/99 |
| 4,005,027 | 1/1977 | Hartman | 252/95 |
| 4,011,172 | 3/1977 | Marsan et al. | 252/187 |
| 4,029,591 | 6/1977 | Ohbu et al. | 252/95 |

(List continued on next page.)

FOREIGN PATENT DOCUMENTS

| | | |
|---|---|---|
| 1120370 | 3/1982 | Canada . |
| 3625 | 8/1979 | European Pat. Off. . |
| 886046 | 1/1941 | France . |
| 6806824 | 10/1968 | South Africa . |
| 522097 | 6/1940 | United Kingdom . |
| 1418671 | 12/1975 | United Kingdom . |
| 1534680 | 12/1978 | United Kingdom . |
| 2031455 | 2/1983 | United Kingdom . |

OTHER PUBLICATIONS

"Conoco Catapal ® SB Alumina," Jan. 1981.

"Condea High Purity Aluminas".

"Remet Chemical Corporation, Product Data," Jan. 12, 1981; May 4, 1981.

Condea Chemie Pural Puralox Disperal High Purity Aluminas.

*Primary Examiner*—Prince E. Willis

*Attorney, Agent, or Firm*—Joel J. Hayashida; Michael J. Mazza; Stephen M. Westbrook

[57] ABSTRACT

The invention provides a thickened aqueous abrasive scouring cleanser containing bleach which is capable of stably suspending abrasives, has excellent bleach half-life stability, little or no syneresis and maintains these advantages over extended times and at elevated temperatures.

In one embodiment of the inventive cleansers is provided a hard surface abrasive scouring cleanser comprising:

(a) a colloidal aluminum oxide thickener having average particle size, in dispersion, of no greater than about 1 micron;

(b) an electrolyte/buffer to promote the environment in which the aluminum oxide and surfactant can associate to provide proper rheology;

(c) at least one surfactant which can, in association with the aluminum oxide, provide proper rheology and cleaning;

(d) a halogen bleach; and (e) a particulate abrasive having average particle size of about 1 to 400 microns to provide scouring action.

20 Claims, 2 Drawing Figures

Scanning Electron Microscope Photograph of a dried Alumina Dispersion (10% $Al_2O_3$)

Magnification 20,000 1

U.S. PATENT DOCUMENTS

| | | | |
|---|---|---|---|
| 4,051,055 | 9/1977 | Trinh | 252/95 |
| 4,051,056 | 9/1977 | Hartman | 252/99 |
| 4,057,505 | 11/1977 | Nakagawa et al. | 151/96 |
| 4,062,647 | 12/1977 | Storm et al. | 8/137 |
| 4,071,463 | 1/1978 | Steinhauer | 252/103 |
| 4,079,015 | 3/1978 | Paycot et al. | 252/95 |
| 4,116,849 | 9/1978 | Leikhim | 252/103 |
| 4,116,851 | 9/1978 | Rupe et al. | 252/103 |
| 4,122,025 | 10/1978 | Kiewert et al. | 252/173 |
| 4,133,779 | 1/1979 | Hellyer et al. | 252/547 |
| 4,158,553 | 6/1979 | Chapman | 51/304 |
| 4,174,289 | 11/1979 | Sorgenfrei et al. | 252/103 |
| 4,181,633 | 1/1980 | Colodney et al. | 252/525 |
| 4,203,858 | 5/1980 | Chakrabarti | 252/135 |
| 4,229,313 | 10/1980 | Joy | 252/98 |
| 4,235,732 | 11/1980 | Beyer | 252/103 |
| 4,240,919 | 12/1980 | Chapman | 252/95 |
| 4,248,728 | 2/1981 | Puryear | 252/103 |
| 4,271,030 | 6/1981 | Brierley et al. | 252/98 |
| 4,282,109 | 8/1981 | Citrone et al. | 252/102 |
| 4,283,553 | 8/1981 | Imamura et al. | 252/542 |
| 4,287,079 | 9/1981 | Robinson | 252/99 |
| 4,302,347 | 11/1981 | Straw et al. | 252/116 |
| 4,337,163 | 6/1982 | Schilp | 252/96 |
| 4,352,678 | 10/1982 | Jones et al. | 51/307 |
| 4,379,080 | 4/1983 | Murphy | 252/526 |
| 4,388,204 | 6/1983 | Dimond et al. | 252/98 |
| 4,394,179 | 7/1983 | Ellis et al. | 134/7 |
| 4,397,755 | 8/1983 | Brierley et al. | 252/113 |
| 4,399,056 | 8/1983 | Shipley | 252/431 |
| 4,508,634 | 4/1985 | Elepano et al. | 252/163 |

Scanning Electron Microscope Photograph of a dried Alumina Dispersion (10 % $Al_2O_3$)

Magnification 20 000 : 1

1 μm

THICKENED AQUEOUS ABRASIVE SCOURING CLEANSER

This is a continuation in part of pending application Ser. No. 603,266, filed Apr. 20, 1984, now U.S. Pat. No. 4,599,186.

TECHNICAL FIELD

This invention relates to thickened aqueous scouring cleansers which contain abrasives and a bleach source.

BACKGROUND OF THE INVENTION

In the quest for hard surface cleaners which have efficacy against a variety of soils and stains, various heavy duty cleansers have been developed. As an example, U.S. Pat. No. 3,985,668 issued to Hartman, shows a combination of perlite (an expanded silica abrasive, which is here used as a filler), a colloid-forming clay, in combination with a hypochlorite bleach, a surfactant and a buffer in which abrasives are suspended. A clay thickened system of this type tends to set up or harden upon storage due to the false body nature of the thickeners. They require shaking before use to break down the false body structure. Further prior art cleaners which attempt to suspend abrasives use either inorganic colloid thickeners only or mixed surfactant thickeners at high levels of surfactants. Additionally, syneresis becomes a problem as the solids portion of such cleansers substantially separate from the liquids portion. One way to alleviate this is to use a perlite type material with specified particle size as defined in U.S. Pat. No. 3,985,668, issued to Hartman. Additionally, high levels of surfactants can be used to form a plastic rheology for suspension of abrasives. However, they also have a detrimental effect on hypochlorite stability. These mixed surfactant thickened compositions, for example, U.S. Pat. No. 4,352,678, issued to Jones et al, have been used to suspend abrasives and incorporate a source of hypochlorite bleach. However, this particular reference must incorporate large amounts of surfactants in order to suspend abrasives. This has the unfortunate disadvantage of resultant poor hypochlorite stability in terms of half-life stability at 50° C. for low levels of hypochlorite (0.5% sodium hypochlorite initial level). For the instant purpose, half-life stability is defined as the amount of time it takes for 50% of the initial amount of bleach present in a given composition to decompose.

Other efforts in the cleanser field have included: U.S. Pat. No. 4,337,163, issued to Schilp, which related to a bleach thickened with a combination of amine oxides and anionic surfactants. Abrasives are unable to be suspended in the Schlip formulas. U.S. Pat. No. 4,287,079, issued to Robinson, on the other hand, related to a clay/silicon dioxide thickened, bleach-containing abrasive cleanser which could contain an anionic surfactant. Due to the clay-thickened rheology, cleansers of this sort quickly dry out and set up. While these type of cleansers thus become less flowable over time, they are unfortunately also plagued by significant syneresis problems. U.S. Pat. No. 3,956,158, (also British Pat. No. 1,418,671) issued to Donaldson shows an abrasive-containing bleach thickened with insoluble detergent filaments. As described in U.S. Pat. No. 4,352,678, compositions such as those disclosed in U.S. Pat. No. 3,956,158 have numerous disadvantages, including low detergency and lack of physical and chemical stability at higher temperatures. Lastly, U.S. Pat. No. 3,558,496, issued to Zmoda, shows a hypochlorite bleach thickened with negatively and positively charged clays. Negatively charged clays include smectites, montomorillonites, etc., which are common clays. The positively charged clays was a fibrillar aluminum oxide. The reference does not mention whether abrasives may be suspended by such a thickened bleach. Again, due to presence of the former clays, a false body rheology is likely to occur in which hardening soon occurs and probable increased syneresis is observed.

There therefore remains a need for a thickened hard surface cleanser which is capable of suspending abrasives, exhibits no syneresis over time, does not require shaking before use and has long-term bleach stability.

SUMMARY OF THE INVENTION

In one aspect of the invention, is disclosed a hard surface abrasive scouring cleanser comprising:

(a) a colloidal aluminum oxide thickener having average particle size, in dispersion, of no greater than about 1 micron;

(b) an electrolyte/buffer to promote the environment in which the colloidal aluminum oxide and surfactant can associate to provide proper rheology;

(c) at least one surfactant which can, in association with the aluminum oxide, provide proper rheology and cleaning;

(d) a halogen bleach; and (e) a particulate abrasive having average particle size of about 1 to 400 microns to provide scouring action.

The hard surface abrasive scouring cleansers of the invention provide excellent abrasive suspending and bleach stability in terms of long term half life. Additionally, the cleansers of the invention also show unexpectedly substantially no syneresis. These syneresis values are also stable over time and at elevated temperatures. Because of the resulting physical stability, the cleansers do not require shaking before use to resuspend solids and convert the cleanser into a flowable form. The rheology is adjusted for consistent smooth flowability.

A further embodiment of the invention provides an aqueous hard surface abrasive cleanser without substantial syneresis comprising:

(a) a colloidal alumina thickener having average particle size, in dispersion, no greater than about 1 micron;

(b) a mixed surfactant system which comprises a cleaning-effective and rheology-adjusting amount of at least one anionic surfactant and one bleach-stable nonionic surfactant;

(c) an electrolyte/buffer to promote the environment in which (a) and (b) can associate to provide proper rheology;

(d) a halogen bleach; and (e) a particulate abrasive having average particle size of about 1 to 400 microns to provide proper scouring action.

It is therefore an object of this invention to provide a homogenous aqueous hard surface abrasive scouring cleanser which has the ability to stably suspend abrasive particles.

It is a further object of this invention to provide a hard surface abrasive scouring cleanser which has substantially no syneresis, which is stable over time and at elevated temperatures.

It is a still further object of this invention to provide a hard surface abrasive scouring cleanser which has an excellent shelf stability in terms of bleach half-life.

It is another object of this invention to provide an aqueous hard surface abrasive cleanser which, due to lesser amounts of active utilized, reduces cost as well as provides an effective cleanser.

It is yet another object of this invention to provide an aqueous hard surface abrasive cleanser which does not require shaking before use to resuspend abrasives and other solids.

It is still another object of this invention to provide an aqueous hard surface abrasive cleanser which does not set up or harden over time and therefore remains easily flowable.

It is a further object of this invention to provide an aqueous scouring abrasive cleanser which has demonstrated cleaning efficacy on soap scums, oily soils, and oxidizable stains, e.g., organic stains.

DETAILED DESCRIPTION OF THE INVENTION

Figure 1:
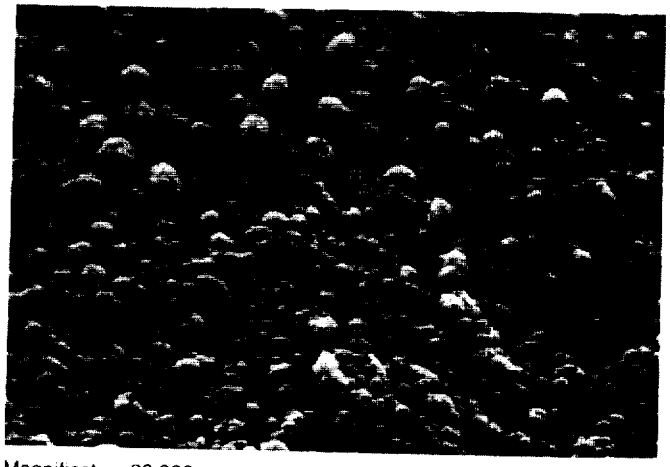
FIG. 1 is a scanning electron micrograph of particles of a dried 10% dispersion of colloidal aluminum oxide (from Condea Chemie, "Pural® Puralox® Disperal® High Purity Aluminas" Brochure (1984)).

The invention provides a hard surface abrasive scouring cleanser having no significant syneresis, stably suspends abrasives, and has excellent bleach half-life. All of the foregoing advantages are present even after these compositions have been tested over time and subjected to elevated temperatures.

Furthermore, as compared to prior art cleaners which include high levels of mixed surfactants, the present invention provides a stably suspended abrasive scouring cleanser which uses relatively small amounts of surfactants which thus lowers the total cost of producing these cleansers.

In one embodiment, the invention provides a hard surface abrasive scouring cleanser comprising;

(a) a colloidal aluminum oxide thickener having average particle size, in dispersion, of no greater than about 1 micron;

(b) an electrolyte/buffer to promote the environment in which the aluminum oxide and surfactants can associate to provide proper rheology;

(c) at least one surfactant which can, in association with the aluminum oxide, provide proper rheology and cleaning;

(d) a halogen bleach; and (e) a particulate abrasive having average particle size of about 1 to 400 microns to provide scouring action.

The crucial ingredients in the invention are the thickeners, namely, a colloidal alumina, or hydrated aluminum oxide, and a surfactant which can be anionic, bleach stable nonionic or amphoteric. Preferably a mixture of different surfactants will be used in the cleansers of this invention. Each of the individual constituents of this invention are profiled in more detail as follows:

ALUMINA

The colloidal thickening component of this invention is provided by an alumina, or hydrated aluminum oxide. A typical alumina is Dispersal® (formerly called "Dispural®"), distributed by Remet Chemical Corp, Chadwicks, N.Y., and manufactured by Condea Chemie, Brunsbuettel, West Germany. Disperal® is an aluminum oxide monohydrate which forms stable colloidal aqueous dispersions. These particular types of aluminas are dry powders which can form thixotropic gels, bind silica and other ceramic substrates, possess a positive charge when dispersed in acidic media, and are substantive to a variety of surfaces. Disperal® has a typical chemical composition of 90% alpha aluminum oxide monohydrate (synthetic boehmite) 9% water, 0.5% carbon (as primary alcohol), 0.008% silicon dioxide, 0.005% ferric oxide, 0.004% sodium silicate, 0.05% sulfur. It has a surface area (BET) of about 320 $m^2/gm$, average undispersed particle size (as determined by sieving) of 15% (greater than 45 microns) and 85% (less than 45 microns), a particle size in dispersion of about 0.0048 micron (as determined by x-ray diffraction), and bulk density of 45 $lbs./ft.^3$ (loose bulk) and 50 $lbs./ft.^3$ (packed bulk).

Yet another alumina suitable for use, albeit not as preferred, is Catapal® SB Alumina, manufactured by Conoco Chemicals Company, Houston, Tex. Catapal® SB has a typical chemical composition of 74.2% aluminum oxide (boehmite), 25.8% water, 0.36% carbon, 0.008% silicon dioxide, 0.005% ferric oxide, 0.004% sodium oxide, and less than 0.01% sulfur. It has a surface area (BET) of 280 $m^2/gm$, average undispersed particle size (as determined by sieving) of 38% (less than 45 microns) and 19% (greater than 90 microns).

These colloidal alumina thickeners as used dispersed in the invention, generally have exceedingly small average particle size in dispersion (i.e., generally less than 1 micron, see, e.g., FIG. 1 of the drawings, which shows particles of a dried colloidal alumina dispersion). In point of fact, the average particle size diameter of these thickeners when dispersed is likely to be around 0.0048 micron. Thus, a preferred average particle size range in dispersion is preferably less than 1 micron, more preferably less than about 0.5 micron and most preferably less than 0.1 micron. Due to their small particle size, little or substantially no abrasive action is provide by these types of thickeners even though they are chemically insoluble, inorganic particles. Additionally, these colloidal aluminas are chemically quite different from aluminum oxide abrasives, such as corundum. Colloidal aluminas are produced from synthetic boehmite. In general, they are synthesized by hydrolyzing aluminum alcoholates, with the resulting reaction products being hydrated aluminum oxide (colloidal alumina) and three fatty alcohols. The reaction equation is set forth below:

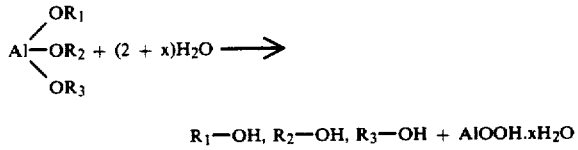

(From Condea Chemie, "Pural® Puralox® Disperal® High Purity Aluminas" Brochure (1984), the contents of which are herein incorporated by reference.).

These hydrated aluminum oxides are called synthetic boehmites merely because their crystalline structure appears similar to that of naturally occurring boehmite. Boehmite, which is the actual mineral, has a Mohs hardness of about 3. It may thus be expected that the synthetic boehmite would not have a hardness greater than the naturally occurring boehmite. Corundum, on the other hand, appears to have a Mohs hardness of at least 8 and perhaps higher. Thus any abrasive action provided by colloidal aluminum oxides may be severely mitigated due to their relative softness. An important aspect of the hydrated aluminas used herein is that they should be chemically insoluble, i.e., should not dissolve in acidic, basic or neutral media in order to have effective thickening as well as stability properties. However, colloidal aluminas will dissolve in highly basic media, e.g., 50% NaOH.

Figure 2:
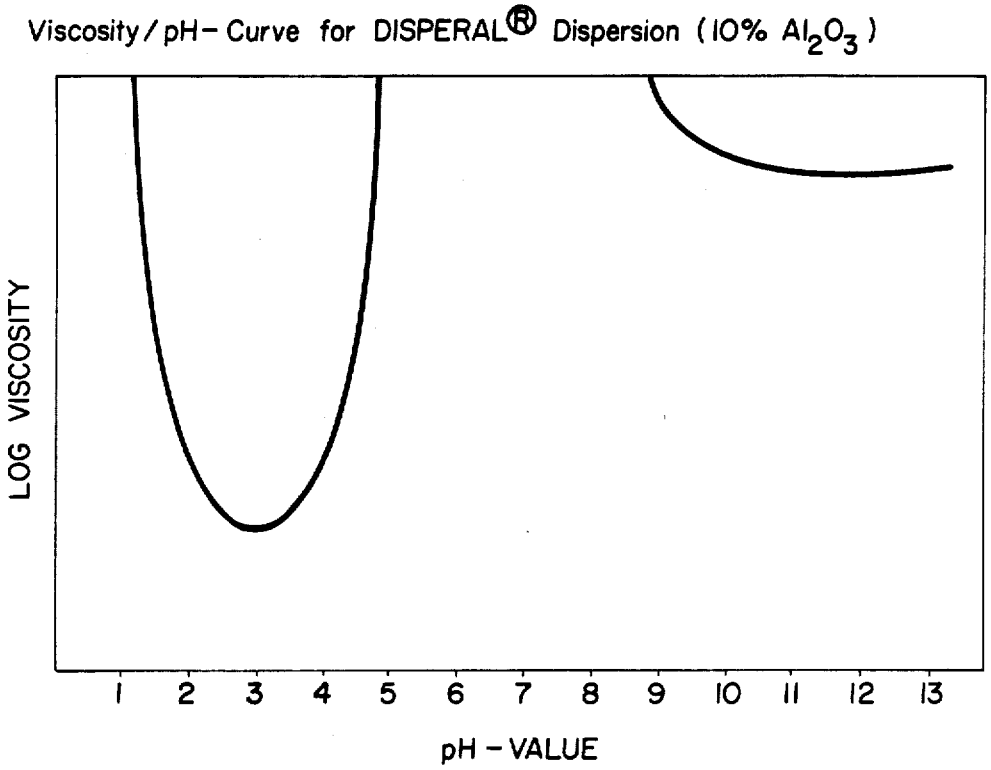
FIG. 2 is a Viscosity/pH curve showing the rheologic behavior of a 10% dispersion of colloidal aluminum oxide depending upon pH (also from Condea Chemie Brochure, above).

A further important point is that these colloidal alumina thickeners, in order to be useable as thickeners in the cleaners of this invention, must be initially dispersed in aqueous dispersion by means of strong acids. Preferable acids used to disperse these colloidal aluminas include, but are not limited to, acetic, nitric and hydrochloric acids. Sulfuric acid is not preferred. Generally, a 1–50%, more preferably 5–40%, and most preferably 10–35% dispersion is made up, although in the Examples shown in Table I, below and following, percentages of colloidal alumina are calculated for 100% (i.e., as if non-dispersed) active content. In practice, the colloidal alumina may be dispersed in water sufficient to make up the desired % dispersion and then the acid may be added thereto. Or, the acid may be first added to the colloidal alumina and then dispersed in water. In either case, a good amount of shearing (i.e., mixing in a mixing vat) is required to obtain the proper rheology. Usually, a relatively small amount of concentrated acid is added, for instance, for a 25 wt.% dispersion, 25% alumina monohydrate may be combined with 1.75% concentrated (12M) hydrochloric acid and then dispersed in 73.75% water. FIG. 2, viscosity/pH graph, shows the behavior of a 10% colloidal aluminum oxide dispersion depending on pH.

SURFACTANTS

As mentioned herein above, the surfactants suitable for use in this invention are selected from anionic, bleach-stable nonionic, amphoteric, zwitterionic surfactants and mixtures thereof. It is especially preferred to use a combination of anionics and bleach-stable nonionics.

The anionic surfactants are selected from bleach/stable surfactants such as alkali metal alkyl sulfates, secondary alkane sulfonates, linear alkyl benzene sulfonates, and mixtures thereof. These anionic surfactants will preferably have alkyl chain groups averaging about 8 to 20 carbon atoms. In practice, any other anionic surfactants which do not degrade chemically when in contact with a hypohalite, e.g., hypochlorite, bleaching species should also work. An example of a particularly preferred secondary alkane sulfonate is HOSTAPUR SAS, manufactured by Farbwerke Hoechst A.G., Frankfurt, West Germany. An example of typical alkali metal salts of alkyl benzene sulfonic acids are those sodium alkyl benzene sulfonates manufactured by Pilot Chemical Company sold under the trademark Calsoft ®. An example of a typical alkali metal alkyl sulfate is Conco Sulfate WR, sold by Continental Chemical Company which has an alkyl group of about 16 carbon atoms.

Examples of preferred bleach-stable nonionic surfactants are amine oxides, especially trialkyl amine oxides. A representative structure is set forth below:

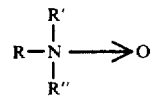

In the structure above, R′ and R″ can be alkyl of 1 to 3 carbon atoms, and are most preferably $CH_3$—, and R is alkyl of about 10 to 20 carbon atoms. When R′ and R″ are both $CH_3$— and R is alkyl averaging about 12 carbon atoms, the structure for dimethyldodecylamine oxide, a particularly preferred amine oxide, is obtained. Representative examples of these particular type of bleach-stable nonionic surfactants include the dimethyldodecylamine oxides sold under the trademark Ammonyx ® LO by Onyx Chemical Division of Millmaster Onyx Ltd., Northampton, England. Yet other preferred amine oxides are those sold under the trademark Barlox ®, by Baird Chemical Industries, Inc. Still others include the Conco XA series, sold by Continental Chemical Company, the Aromax series sold by Armour Industrial Chemical Company, and the Schercamox series, sold by Scher Brothers, Inc. These amine oxides preferably have main alkyl chain groups averaging about 10 to 20 carbon atoms. Other types of suitable surfactants include amphoteric surfactants, exemplary of which are betaines, imidazolines and certain quaternary phosphonium and tertiary sulfonium compounds. Particularly preferred are betaines such as N-carboxymethyl-N-dimethyl-N-(9-octadecenyl)ammonium hydroxide and N-carboxymethyl-N-cocoalkyl-N-dimethyl ammonium hydroxide, the latter of which is sold under the trademark Lonzaine ® by Lonza Corporation.

As mentioned previously, it is particularly preferred to combine at least two of these surfactants, most preferably the anionics and the bleach stable nonionics. Combinations of these types of surfactants appear to be particularly favorable to maintaining hypochlorite half-life stability at elevated temperatures for long periods of time. Additionally, when these particular combinations of surfactants are combined with the alumina thickener, the formulations thus produced are practically free from syneresis.

Determining an appropriate mixture of alumina and surfactants is very important to the invention. While theoretically anywhere from about 1% to 25% alumina can be used, and about 0.1 to 15% surfactants (anionic, bleach stable nonionic or mixtures thereof), so long as proper rheology (plastic, flowable), desirable bleach stability and lack of phase separation or syneresis result, in practice it is preferred to use minimal quantities of these "actives." (Note: Commercially available surfactants are generally sold as solutions, e.g., Hostapur SAS (Hoechst A.G.) is a 60% sodium paraffin sulfonate solution, and Ammonyx LO (Onyx Chemical Division of Millmaster Onyx Corp.) is a 30% amine oxide solution. However, as in the case with the colloidal alumina thickener dispersions discussed above, in the Examples shown in TABLE I below and following, the percentages of each surfactant used is calculated as if 100% surfactant were used).

The amount of each active added is dictated by the type of product performance desired, i.e., thickening, cleaning, lack of or substantially no syneresis, abrasive suspending or bleach stabilizing. The amount that is ordinarily used is an amount which is both abrasive-suspending and cleaning-effective amount. Applicants have found that preferably about 2% to 10%, and most preferably about 3% to 8% alumina, and preferably about 0.25% to 5.0%, most preferably about 0.5% to 3.0% of total surfactant are used in the cleansers of this invention. These ranges appear to result in compositions having the desired syneresis values, ability to suspend abrasives, optimal bleach half-lives, and, because of the reduced amount of actives in the compositions, lower overall manufacturing costs. It is crucial to use this combination of alumina and surfactants. As mentioned, using a mixed surfactant system alone, in high amounts to provide proper rheology (plastic) for suspension of abrasives, results in reduced bleach half-life when a bleach is incorporated. Alumina, by itself, on the other hand, provides a composition with unacceptable syneresis.

However, with respect to optimal bleach stability, therefore also shelf stability in terms of bleach half-life, and syneresis values, it has been further surprisingly discovered that there is a most preferred total amount of surfactant present, namely, 0.5% to 3.0% by weight of the cleanser. This range thus appears to be a critical range, since exceeding it tends to lessen the bleach stability and may also increase syneresis values, although acceptable products may still occur at higher levels and are still considered part of this invention. Total surfactant levels below this range may not successfully provide plastic flow characteristics and lessen overall performance attributes of the cleansers, although such lower levels are still within the invention. As shown in TABLES II and III below, best results occur with this critical range of surfactant and when the two different types of surfactant are used, namely anionic and bleach-stable nonionic.

With respect to thickening, it should be noted that while there are many types of inorganic and organic thickeners, not all will provide the proper type of plastic, flowable rheology desired in the invention. Common clays, for instance, those used in U.S. Pat. No. 3,985,668 and U.S. Pat. No. 3,558,496, will likely lead to a false body rheology. False body rheology pertains to liquids which, at rest, turn very viscous, i.e., form gels. Problematic with such false body liquids is that they appear to tend to thicken very rapidly and harden or set up so that flowability is a problem. A thixotropic rheology is also not particularly prefered in this invention if accompanied by a high yield stress value, since in the thixotropic state, a liquid at rest also thickens dramatically, but, theoretically, should flow upon shearing. If the thixotrope has a high yield stress value, as typically found in clay-thickened liquid media, the fluid at rest may not re-achieve flowability without shaking or agitation. As a matter of fact, if colloidal alumina alone is used to thicken the liquid cleansers of this invention, a thixotrope with high yield stress values appears to result. This type of product would not be preferred, for the reasons stated above. This indicates that the surfactants included in the formulas of this invention are crucial towards achieving plastic rheology. Ordinarily, a thixotrope should flow from a dispenser upon shaking or squeezing. An example of a typical thixotrope is catsup, which sometimes requires quite a bit of shaking and pounding of the bottle bottom to induce flow.

The type of rheology desired in this invention is a plastic, flowable rheology. This sort of rheology does not require shearing to promote fluidity. Thus, a product made in accordance with this invention will not generally require squeezing (assuming a deformable plastic squeeze bottle), shaking or agitation to flow out of a container or dispenser. Attaining this rheology with the inventive cleansers was very surprising since, although it is known that combinations of surfactants can result in this rheology (e.g., U.S. Pat. Nos. 4,129,527 and 4,352,678), addition of the aluminum oxide thickeners might ordinarily be expected to affect the rheology differently. It was surprising that the aluminum oxide thickeners would promote such plastic rheology while also stably suspending abrasives and not causing bleach instability. Nothing in the art had ever disclosed the use of colloidal aluminas as a thickener in the household hard surface cleaner field. One patent, U.S. Pat. No. 3,558,496, had suggested coupling an aluminum oxide with common clays to thicken hypochlorite, but had not indicated omitting the clay and adding surfactants would lead to the desired plastic rheology of this invention.

ELECTROLYTES/BUFFERS

The electrolyte/buffers appear to promote the favorable environment in which the surfactants and the alumina can combine. Electrolytes function, on the one hand, to provide sources of ions in aqueous solution. This provides a charged medium in which the alumina thickener and surfactants can interact, providing the favorable plastic rheology of the invention. Buffers, on the other hand, may act to maintain pH, and in this instance, alkaline pH is favored for purposes of both rheology and maintaining hypochlorite stability. Some compounds will serve as both buffer and electrolyte. These particular buffers/electrolytes are generally the alkali metal salts of various inorganic acids, to wit the alkali metal salts of phosphates, polyphosphates, pyrophosphates, triphosphates, tetraphosphates, silicates, metasilicates, polysilicates, carbonates, hydroxides, and mixtures of the same. Certain divalent salts, e.g., alkaline earth salts of phosphates, carbonates, hydroxides, etc., can function singly as buffers. If such compounds were used, they would be combined with at least one of the previous electrolytes/buffers mentioned to provide the appropriate pH adjustment. It may also be suitable to use as buffers such materials as aluminosilicates (zeolites), borates, aluminates and bleach-stable organic materials, such as gluconates, succinates, maleates, and their alkali metal salts. These electrolyte/buffers function to keep the pH ranges of the inventive cleansers preferably above 7.0, more preferably at between about 10.0 to 14.0. The amount of electrolyte/buffer can vary from about 1.0% to 25.0%, preferably 1.0 to 10.0%.

HALOGEN BLEACH

A source of bleach is selected from various halogen bleaches. For the purposes of this particular invention, halogen bleaches are particularly favored. As examples thereof, the bleach may be preferably selected from the group consisting essentially of the alkali metal and alkaline earth salts of hypohalite, hypohalite addition products, haloamines, haloimines, haloimides and haloamides. These also produce hypohalous bleaching species in situ. Preferred is hypochlorite and compounds producing hypochlorite in aqueous solution, although hypobromite is another potential halogen bleach. Representative hypochlorite producing compounds include sodium, potassium, lithium and calcium hypochlorite, chlorinated trisodium phosphate dodecahydrate (hypohalite addition product), potassium and sodium dichloroisocyanurate, trichlorocyanuric acid, dichlorodimethyl hydantoin, chlorobromo dimethylhydantoin, N-chlorosulfamide (haloamide), and chloramine (haloamine). Particularly preferred in this invention is sodium hypochlorite having the chemical formula NaOCl, in an amount ranging from about 0.25% to about 15%, more preferably about 0.25% to 5%, most preferably about 0.5% to 2.0%. The purpose for the bleach is evident. This particular sort of oxidizing cleaning agent is very effective against oxidizable stains, e.g., organic stains. The principle problem with bleach is also apparent—in combination with most actives in an aqueous system, oxidation occurs, and the bleach's efficacy can be greatly reduced. As mentioned, it is particularly surprising that in the composition of this invention, bleach stability as expressed in half-lives is so excellent, which, in a commercial setting, is a necessary requirement to market a shelf-stable product that maintains its efficacy throughout its shelf-life.

ABRASIVES

Abrasives are used in the invention to promote cleaning action by providing a scouring action when the cleansers of the invention are used on hard surfaces. Preferred abrasives include silica sand, but other hard abrasives such as a perlite, which is an expanded silica, and various other insoluble, inorganic particulate abrasives can be used, such as quartz, pumice, calcium carbonate, feldspar, melamine granules, urea formaldehyde, tripoli and calcium phosphate. Abrasives can be present in amounts ranging from about 5 to 55% by weight of the compositions of this invention. Particle size will range from average particle size of about 1 to 400, more preferably 5 to 300, most preferably 10 to 250 microns. Abrasives are generally sold as grades based on U.S. Mesh Sieve sizes. The U.S. Sieve sizes are inversely related to measurements in microns, wherein 80 mesh sieves correspond to about 180 microns, and 325 mesh sieves correspond to about 45 microns. For one preferred grade of abrasives used in this invention, namely grade 140 mesh, more than about 20% of the particles will be retained on a U.S. 325 mesh sieve (i.e., is greater than about 45 microns). Particle hardness of the abrasives can range from Mohs hardness of about 2–10, more preferably 3–8. Abrasives are generally insoluble inorganic materials (although there are some organic abrasives, to wit, corn cobs, rice hulls, melamine granules, urea formaldehyde etc.). Some thickeners are also insoluble inorganic materials, for instance, the colloidal aluminum oxide thickeners of this invention. However, the colloidal alumina thickeners of this invention distinguish from aluminum oxide abrasives in many aspects. Colloidal alumina thickeners appear to have an average particle size of much smaller than 1 micron. Aluminum oxide abrasives on the other hand will be much larger (can range up to 500 microns) and even in aqueous dispersion, will not thicken the cleansers of this invention. As mentioned above, the colloidal alumina thickeners must be initially dispersed in acidic media to provide thickening. Further, without the aluminum oxide thickeners of this invention, abrasives, even aluminum oxide, cannot be stably suspended.

Further desirable adjuncts include bleach stable dyes (e.g., anthraquinone dyes), pigments (e.g., ultramarine blue), colorants and fragrances in relatively low amounts, e.g., about 0.001% to 5.0%, each, by weight of the composition.

The invention can be further exemplified by the results shown below.

TABLE I shows typical ranges for the compositions of this invention, TABLE II shows the favorable syneresis displayed by these cleansers, and TABLES III–IV show the surprising hypochlorite half-lives displayed by the cleansers of this invention over an extended period of time and at elevated temperature. Further, TABLES V–VII show performance benefits of these cleansers against various stains. TABLE VIII shows a preferred formula on a batch scale and describes a method of making same. (Note in this TABLE VIII, the amounts added are not calculated as if 100% active ingredients were used. Instead, since this is a commercial scale, the actual amounts of commercially available ingredients were used.)

TABLE I

| FORMULA[1] | PERCENT $Al_2O_3.H_2O$ | PERCENT BUFFER | PERCENT ACTIVE ANIONIC SURFACTANT[2] | PERCENT ACTIVE AMINE OXIDE[3] | PERCENT NaOCl, INITIAL |
|---|---|---|---|---|---|
| 1 | 6 | 5[4] | 1 | 1 | 0.842 |
| 2 | 5 | 5[4] | 0.5 | 1 | 0.848 |
| 3 | 5 | 5[4] | 1 | 0.5 | 0.846 |
| 4 | 5 | 3.5[4] | 1.5 | 0.5 | 0.842 |
| 5 | 6 | 3.5[4] | 1.5 | 1 | 0.848 |
| 6[6] | 4.5 | 4.5[5] | 0.875 | 0.8 | 0.851 |
| 7[6] | 4.5 | 5[5] | 1.25 | 0.8 | 0.896 |
| 8[6] | 5 | 5[5] | 0.875 | 0.8 | 0.899 |
| 9 | 5 | 5[5] | 1 | — | — |
| 10 | 5 | 5[5] | — | 1 | — |

[1]In addition to materials listed, all formulas contain 30% silica sand, 3% tetrapotassium pyrophosphate, and deionized water.
[2]Secondary alkane sulfonate (Hostapur SAS)
[3]Dimethyldodecylamine oxide (Ammonyx LO)
[4]$Na_3PO_4$
[5]$K_3PO_4$
[6]Samples also contain 0.075% fragrance oils.

TABLE II

| SYNERESIS VALUES FOR EXAMPLES 1-10 | |
|---|---|
| EXAMPLE | PERCENT SYNERESIS LAYER[1] |
| 1 | 0%(3)[2] |
| 2 | 0%(3)[2] |
| 3 | 0%(3)[2] |
| 4 | 0%(3)[2] |
| 5 | 0%(3)[2] |
| 6 | 0%(2)[2] |
| 7 | 0%(2)[2] |
| 8 | 0%(2)[2] |
| 9 | 11%(2)[2] |
| 10 | 15%(2)[2] |

TABLE II shows that examples 1–8 listed in TABLE I had substantially no syneresis for three months. This indicates lengthy physical stability which serves a commercial product very well. If only one surfactant, as in Examples 9–10, is used, less desirable syneresis occurs, but such Examples are still within the invention.

TABLE III

| NaOCl HALF-LIVES FOR EXAMPLES 1-10 | |
|---|---|
| EXAMPLE | NaOCl HALF-LIFE AT 120° F., HOURS |
| 1 | 288 |
| 2 | 264 |
| 3 | 576 |
| 4 | 480 |
| 5 | 408 |
| 6 | 288 |
| 7 | 288 |
| 8 | 264 |
| 9 | — |
| 10 | — |

TABLE III shows that each of the examples in TABLE I has excellent hypochlorite bleach half-life at *elevated* temperatures over a number of days, not merely hours. The must preferred stabilities show half-lives exceeding about 250 hours (about 10½ days) at 120° F. Additionally, it is surprising that such a high concentration (over 0.8%) would remain stable for such extended periods, since in previous formulas depicted in the art, bleach half-life stability was fairly poor even when low amounts (0.5% or less) of bleach were initially present.

TABLE IV below shows NaOCl stabilities at room temperature (70°).

TABLE IV

| NaOCl HALF-LIVES (AT 70° F.) FOR EXAMPLES 1-10 | |
|---|---|
| EXAMPLE | % NaOCl REMAINING AT 70° F., DAYS |
| 1 | 67 (155 days) |
| 2 | 64 (155 days) |
| 3 | 82 (144 days) |
| 4 | 81 (163 days) |
| 5 | 59 (167 days) |
| 6 | 76 (120 days) |
| 7 | 73 (120 days) |
| 8 | 73 (120 days) |
| 9 | * |
| 10 | ** |

*Expected to exhibit most NaOCl remaining.
**Expected to exhibit lower remaining NaOCl.

These particular examples show that the cleansers of this invention have actual application as commercial products. For the instant purpose, acceptable values for % remaining NaOCl are at least 50% remaining NaOCl after about five months.

Performance of the inventive composition was compared against commercially available cleansers. For comparison TABLES IV–VI, the following preferred formula was used:

EXAMPLE 11

| INGREDIENT | WEIGHT % |
|---|---|
| Dispural ®[1] | 5% |
| Hostapur SAS ®[2] | 0.875% |
| Ammonyx ® LO[3] | 0.8% |
| $K_3PO_4$[4] | 5% |
| $K_4P_2O_7$[4] | 3% |
| NaOCl | 0.8% |
| $TiO_2$[5] | .75% |
| Fragrance | 0.04% |
| Silica Sand (140 mesh) | 30% |

-continued

| INGREDIENT | WEIGHT % |
|---|---|
| Water | Balance |

[1]$Al_2O_3.H_2O$, manufactured by Condea Chemie, Brunsbuettel, West Germany.
[2]Secondary alkane sulfonate surfactant, manufactured by Farbwerke Hoechst A.G., Frankfurt, West Germany.
[3]Amine oxide surfactant, manufactured by Onyx Chemical Division of Millmaster Onyx Corporation.
[4]Buffer/electrolyte.
[5]Pigment.

For TABLE V below, the oily-grease soil removal capacity of Example 11 was compared against those of two commercial cleansers. In the results that follow, the inventive formula out-performed all the compared commercial products.

In TABLE V, Gardner Soil Removal protocol was followed. An oily/grease soil was prepared by mixing vegetable oil and lard. A 150 micron layer was laid on a porcelain steel panel. This was tested on a Gardner Heavy Duty Wear Tester No. 249 (Gardner Laboratories, Baltimore, Md.), the scrubbing sponge having a water content of 5:1 (water:sponge) (100 ppm 3:1 $Ca^{++}$:$Mg^{++}$ water hardness). 3 grams of each tested product were used in cleaning, except that Comet® powder cleanser was applied as a 4 grams of a 3:1 product: water slurry. The cleaning results were graded by an impartial panel of five testers, grading on a 1 to 10 scale, wherein 1=no cleaning and 10=total cleaning. The results were the average of 10 replicates.

TABLE V

| OILY-GREASE SOIL REMOVAL | |
|---|---|
| PRODUCT | VISUAL GRADE |
| Example 11 | 6.9 |
| Comet ®[1] Powder | 6.7 |
| Comet ®[1] Liquid | 2.7 |

[1]Registered trademark of Proctor & Gamble Co., Cincinnati, Ohio

In TABLE V, all conditions were as in TABLE IV above, however, the soil was calcium stearate on glazed black ceramic tiles to duplicate typical soap scrum.

TABLE VI

| SOAP SCUM REMOVAL | |
|---|---|
| PRODUCT | VISUAL GRADE |
| Example 11 | 7.5 |
| Comet ®[1] Powder | 5.6 |
| Comet ®[1] Liquid | 2.2 |

[1]Registered trademark of Procter & Gamble Co., Cincinnati, Ohio.

In TABLE VII, conditions differed from those TABLES IV and V below. The soil was tea on etched porcelain enameled steel plates, which soil was "fixed" with ferrous sulfate. The tested products were left to soak on the resulting stains for the two indicated times, then rinsed. The same grading scales and protocol were used, except that four impartial testers were used and the results are an averaged score from two replicates.

TABLE VII

| TEA STAIN BLEACHING | | |
|---|---|---|
| PRODUCT | VISUAL GRADE (After 10 Seconds) | VISUAL GRADE (After 30 Seconds) |
| Example 11 | 9.0 | 9.4 |
| Comet ®[1] Powder 1:1[2] | 5.9 | 9.1 |
| Comet ®[1] Powder 3:1[3] | 2.5 | 3.4 |

TABLE VII-continued

| PRODUCT | TEA STAIN BLEACHING VISUAL GRADE (After 10 Seconds) | VISUAL GRADE (After 30 Seconds) |
|---|---|---|
| Comet ®[1] Liquid | 8.0 | 9.3 |

[1]Registered trademark of Procter & Gamble Co., Cincinnati, Ohio.
[2]Added as a 1:1 product: water slurry.
[3]Added as a 3:1 product: water slurry Review of the above experimental data shows that the compositions of the invention have excellent bleach half-life stability, lack of syneresis, ability to stably suspend abrasives, and maintain these advantageous features over extended times and at elevated temperatures. Their performances as shown in TABLES IV-VI, are overall better than any of the leading commercial products depicted over a wide range of soils.

The above examples have been depicted solely for purposes of exemplification and are not intended to restrict the scope or embodiments of the invention. The invention is further illustrated with reference to the claims which follow hereto.

TABLE VII

PREFERRED BATCH FORMULA AND METHOD OF MAKING

A. Alumina Monohydrate Dispersion

To make an alumina dispersion suitable for use in the invention, the colloidal alumina must first be acidified. This is done by taking the following materials and preparing as follows:

| | |
|---|---|
| Aluminum Monohydrate | 25.0% |
| Hydrochloric Acid (12 M) | 1.75% |
| Deionized Water | 73.25% |

The above materials were processed as follows: The alumina was acidified and sheared by mixing in a large vat with an impeller blade. After mixing a sufficiently long period of time, the deionized water was added and mixing was renewed. Additionally, the alumina and water can be added together first at very high shear, and then acidified.

B. Preferred Batch Formula

| Ingredient | Manufacturer | Wt. % |
|---|---|---|
| Alumina Monohydrate Dispersion (25%) | Remet Chemical/Condea | 20.000 |
| Tripotassium Phosphate (50%) | FMC Corp. | 10.000 |
| Lauryl Dimethyl Amine Oxide (30%) | Onyx Chemical Corp. | 2.670 |
| Secondary Alkane Sulfonate (Paraffin Sulfonate) (60%) | Hoechst A.G. | 1.450 |
| Silica Sand (140 mesh) | | 30.000 |
| Tetrapotassium Pyrophosphate (60%) | FMC Corp. | 5.000 |
| Sodium Hypochlorite (5.25%) | The Clorox Co. | 16.890 |
| Titanium Dioxide | E.I. DuPont | 0.750 |
| Fragrance Oil | IFF | 0.040 |
| Deionized Water | | 13.225 |
| | | 100.000% |

In the above formula, the titanium dioxide added is a pigment. If a green-tinted formula is desired, 0.025 Colanyl green pigment from American Hoechst can be added, and the deionized water can be reduced by a corresponding amount.

What is claimed is:

1. A hard surface abrasive scouring liquid cleanser without substantial syneresis and which does not require shaking before use in order to fluidize comprising:
   (a) a colloidal aluminum oxide thickener having an average particle size, in dispersion, of no greater than about 1 micron, and present in a thickening effective amount;
   (b) an electrolyte/buffer present in an amount sufficient to promote the environment in which the aluminum oxide and at least one surfactant can associate to provide proper rheology;
   (c) at least one bleach-stable surfactant selected from the group consisting essentially of betaines, amine oxides, imidazolines, quaternary ammonium and tertiary sulphonium compounds, and mixtures thereof, which, in association with the aluminum oxide, provides a plastic flowable rheology and proper cleaning, the surfactant being present in a cleaning-effective and abrasive-suspending amount;
   (d) a halogen bleach; and
   (e) a particulate abrasive having an average particle size of about 1 to 400 microns to provide scouring action.

2. The cleanser of claim 1 wherein the electrolyte/-buffer is selected from the group consisting essentially of alkali metal and alkaline earth: phosphates, silicates, carbonates, hydroxides; and mixtures thereof.

3. The cleanser of claim 2 wherein said alkali metal and alkaline earth phosphates are selected from the group consisting essentially of polyphosphates, pyrophosphates, triphosphates, tetraphosphates, and mixtures thereof; and said alkali metal and alkaline earth silicates are selected from the group consisting essentially of metasilicates, polysilicates, and mixtures thereof.

4. The cleanser of claim 1 wherein the halogen bleach is selected from the group consisting essentially of the alkali metal and alkaline earth salts of hypohalite, haloamines, haloamides, and haloimides.

5. The cleanser of claim 1 wherein the particulate abrasive is silica sand.

6. The cleanser of claim 1 further comprising an anionic surfactant selected from the group consisting essentially of alkali metal alkyl sulfates, secondary alkane sulfonates, linear alkyl benzene sulfonates, and mixtures thereof.

7. The cleanser of claim 1 wherein the bleach-stable surfactant is an amine oxide.

8. The cleanser of claim 1 wherein the colloidal aluminum oxide thickener is substantially a synthetic boehmite, having a Mohs hardness of about three or less.

9. The cleanser of claim wherein the half-life of the bleach is over 250 hours at 50° C.

10. The cleanser of claim 1 wherein the aluminum oxide thickener is present in an amount of about 1% to 25%, the electrolyte/buffer is present in an amount of about 1% to 25%, the surfactant is present in an amount of about 0.1% to 15%, the halogen bleach is present in an amount of about 0.25 to 15%, and the abrasive is present in an amount of about 5 to 55%, all based on the weight of the cleanser.

11. An aqueous hard surface abrasive liquid cleanser without substantial syneresis, and which does not require shaking before use in order to fluidize, comprising:

(a) a collodial alumina thickener having an average particle size, in dispersion, of no greater than about 1 micron, and present in a thickening-effective amount;

(c) a mixed surfactant system which comprises a cleaning-effective and abrasive-suspending amount of at least one anionic surfactant selected from the group consisting essentially of alkali metal alkyl sulfates, secondary alkane sulfonates, linear alkyl benzene sulfonates, and mixtures thereof, and one bleach-stable surfactant selected from the group consisting essentially of amine oxides, betaines, imidazolines, quaternary ammonium and tertiary sulfonium compounds, and mixtures thereof;

(c) an electrolyte/buffer present in an amount sufficient to promote the environment in which (a) and (b) can associate to provide a plastic flowable rheology;

(d) a halogen bleach; and (e) a particulate abrasive having an average particle size of about 1 to 400 microns to provide proper scouring action.

12. The cleanser of claim 11 wherein the colloidal alumina thickener is substantially a synthetic boehmite having a Mohs hardness of about three or less.

13. The cleanser of claim 11 wherein the electrolyte/-buffer is selected from the group consisting essentially of alkali metal and alkaline earth: phosphates, silicates, carbonates, hydroxides; and mixtures thereof.

14. The cleanser of claim 13 wherein said alkali metal and alkaline earth phosphates are selected from the group consisting essentially of polyphosphates, pyrophosphates, triphosphates, tetraphosphates, and mixtures thereof; and said alkali metal and alkaline earth silicates are selected from the group consisting essentially of metasilicates, polysilicates, and mixtures thereof.

15. The cleanser of claim 11 wherein the halogen bleach is selected from the group consisting essentially of the alkali metal and alkaline earth salts of hypohalite, haloamines, haloamides, and haloimides.

16. The cleanser of claim 11 wherein the abrasive is silica sand.

17. The cleanser of claim 11 wherein the alumina is present in an amount of about 1% to 25%, the mixed surfactant system is present in an amount of about 0.1% to 15.0%, the electrolyte/buffer is present in an amount of about 1% to 25%, the bleach is present in an amount of about 0.25 to 15%, and the abrasive is present in an amount of about 5 to 55%, based on the weight of the cleanser.

18. The cleanser of claim 17 wherein the half-life of the bleach is over 250 hours at 50° C.

19. A method for cleaning a hard surface comprising:

contacting a hard surface having a stain thereon with a hard surface abrasive scouring liquid cleanser which does not require shaking before use in order to fluidize which comprises:

(a) a colloidal aluminum oxide thickener having an average particle size, in dispersion, of no greater than about 1 micron, the thickener being present from about 1% to 25% by weight of the composition;

(b) an electrolyte/buffer present in an amount of from about 1 to 25% by weight to promote the environment in which the aluminum oxide and at least one surfactant can associate to provide a plastic flowable rheology;

(c) at least one surfactant chosen from the group consisting essentially of amine oxides, betaines, quaternary ammonium compounds, tertiary sulfonium compounds and imidazolines, the surfactant being present in amount from about 0.1 to 15% by weight and which, in association with the aluminum oxide, provides said plastic flowable rheology and proper cleaning;

(d) a halogen bleach, present in an amount of from about 0.25 to 15% weight; and (e) a particulate abrasive having an average particle size between about 1 to 400 microns, the abrasive being present in an amount of from about 5 to 55% by weight to provide scouring action; and removing the cleanser and stain.

20. A method for preparing a hard surface abrasive scouring liquid cleanser which does not require shaking before use in order to fluidize comprising:

combining:

(a) between about 1 to 25% by weight of a collodial aluminum oxide thickener having an average particle size, in dispersion, of no greater than about 1 micron;

(b) an electrolyte/buffer, present in an amount of from about 1 to 25% to by weight to promote the environment in which the aluminum oxide and at least one surfactant can associate to provide a plastic flowable rheology;

(c) at least one surfactant selected from the group consisting essentially of amine oxides, betaines, quaternary ammonium compounds, tertiary sulfonium compounds, imidazolines, and mixtures thereof, the surfactant being present in the amount from about 0.1 to 15% and which, in association with the aluminum oxide, provides said plastic flowable rheology and proper cleaning;

(d) a halogen bleach, present in an amount of from about 0.25 to 15% by weight; and (e) between about 5 to 55% of a particulate abrasive having an average particle size of about 1 to 400 microns to provide scouring action.

* * * * *

UNITED STATES PATENT AND TRADEMARK OFFICE

CERTIFICATE OF CORRECTION

PATENT NO. : 4,657,692

DATED : April 14, 1987

INVENTOR(S) : CLEMENT K. CHOY, ET AL

It is certified that error appears in the above—identified patent and that said Letters Patent is hereby corrected as shown below:

Column 1, line 53 change "Schlip" to --Schilp—;

Column 14, line 14, column 15, line 13 and column 16, lines 15 and 43, change "ammonium" to --phosphonium— .

Signed and Sealed this

Twenty-first Day of June, 1988

*Attest:*

DONALD J. QUIGG

*Attesting Officer*

*Commissioner of Patents and Trademarks*